US005265433A

United States Patent [19]

Beckwith

[11] Patent Number: 5,265,433

[45] Date of Patent: Nov. 30, 1993

[54] AIR CONDITIONING WASTE HEAT/REHEAT METHOD AND APPARATUS

[76] Inventor: William R. Beckwith, 15818 Hampton Village Dr., Tampa, Fla. 33618

[21] Appl. No.: 911,516

[22] Filed: Jul. 10, 1992

[51] Int. Cl.[5] ..... F25B 29/00

[52] U.S. Cl. ..... 62/90; 62/173; 62/176.5; 62/513

[58] Field of Search ..... 62/90, 173, 176.5, 238.6, 62/513, 428, 272; 165/104.21

[56] References Cited

U.S. PATENT DOCUMENTS

| | | | |
|---|---|---|---|
| 2,291,029 | 7/1942 | Everetts, Jr. | 62/173 |
| 2,691,273 | 10/1954 | Kramer | 62/513 X |
| 2,713,995 | 7/1955 | Arkoosh et al. | 62/173 X |
| 3,213,934 | 10/1965 | Jentet | 165/104.21 |
| 4,142,379 | 3/1979 | Kuklinski | 62/238.6 X |
| 4,373,346 | 2/1983 | Hebert et al. | 62/238.6 X |
| 4,971,142 | 11/1990 | Mergler | 165/104.14 |
| 4,984,433 | 1/1991 | Worthington | 62/90 |

*Primary Examiner*—Harry B. Tanner

*Attorney, Agent, or Firm*—Dominik, Stein, Saccocio, Reese, Colitz & Van Der Wall

[57] ABSTRACT

An air conditioning method and apparatus comprising a compressor, condenser and evaporator with lines in a primary loop for moving a working fluid in a continuous and automatic cycle of operation between such components; a first reheater located subsequent to the evaporator for heating the post evaporator air with a first supplemental loop coupling the first reheater to the post condenser line; a second reheater located subsequent to the first reheater with a second supplemental loop coupled with the post compressor lines; a valve in the first supplemental loop controlled by a humidistat; and a valve in the second supplemental loop controlled by a thermostat.

8 Claims, 4 Drawing Sheets

AIR CONDITIONING WASTE HEAT/REHEAT METHOD AND APPARATUS

BACKGROUND OF THE INVENTION

1. Field of the Invention

This invention relates to an air conditioning waste heat/reheat method and apparatus and, more particularly, to a method and apparatus for utilizing heat from the post compressor and/or post condenser region of a refrigeration cycle to heat a working fluid to provide a reheating of the air leaving the evaporator.

2. Description of the Background Art

In the field of air conditioning systems, a working fluid capable of changing state under different conditions of a temperature and pressure is utilized for accepting and giving up heat energy in a specific sequence. The working fluid may be Freon, alcohol or similar fluid. In a conventional air conditioning system, the working fluid moves in a cycle of operation between an evaporator, compressor and condenser. The evaporator is generally inside the building to be cooled. At the evaporator, the working fluid is converted from a liquid at about 90 degrees Fahrenheit to a gas at about 45 degrees Fahrenheit for cooling air passing there adjacent. The working fluid then moves from the evaporator to the compressor. The compressor is normally outside and functions to compress the working fluid. The working fluid entering the compressor is a low temperature gas at about 65 degrees Fahrenheit and leaves as a high temperature gas at about 150 degrees Fahrenheit. Movement of the working fluid is then from the compressor to the condenser. The condenser, normally outside, functions to convert the received gas at about 150 degrees Fahrenheit to a liquid at about 90 degrees Fahrenheit.

In some air conditioning systems, the air moving through the evaporator is excessively cooled then reheated. It is standard practice in many applications to excessively cool the air moving through the evaporator taking it from about 80 degrees Fahrenheit to about 50 to 55 degrees Fahrenheit in order to dehumidify the air. Such cooling through the evaporator normally takes the air to a temperature which is cooler than desired for human comfort, but this low temperature is required to properly dehumidify the air. The evaporator, consequently, overcools the air and tends to ring out the moisture therefrom. A reheater must then be used to warm the air to a comfortable level for occupants of the conditioned space. This reheating also provides a lowering of the relative humidity of the overcooled air.

Limited efforts have been made in the past to reheat the post evaporator air to make such air more comfortable for occupants of the air conditioned building. Efforts in the past have also been directed to utilizing the heating of the air at a reheater for cooling various parts of the conventional air conditioning system. Such cooling, to a limited degree, has been through heat-pipe technology. Nothing in the prior art, however, suggests the utilizing of heat-pipe technology for reheating in combination with post compressor and/or post condenser refrigerant cooling without cutting into the existing air conditioning system. By way of example, U.S. Pat. No. 2,111,618 to Erbach and 2,291,029 to Everett disclose the utilization of heat-pipe technology post evaporator for post compressor cooling of the working fluid. These patents are deficient because they require that the primary refrigerant lines be cut into. This requires delicate handling of the refrigerant under the new laws to preclude dispensing of refrigerant to the atmosphere. The refrigerant must be pumped out, the lines are then cut, then resoldered, then pumped out to create a vacuum and finally the refrigerant is reintroduced. Additionally, the reheaters are of an inferior design for the heat-pipe process.

Heat-pipe technology is also utilized in U.S. Pat. Nos. 2,214,057 to Hall; 4,607,498 to Dinh and 4,971,139 to Khattar. In these references, however, the heat-pipe technology is used to transfer heat from return air to supply air. These patents are deficient since these heat-pipes introduce significant pressure drops in the air stream which require additional fan horsepower to overcome. Additionally, these heat-pipes block the access to the cooling coil thereby complicating maintenance and cleaning. Finally these heat-pipes perform their function only when the conventional air conditioning system is in operation. Under seasonal conditions of low heat loads (i.e. fall and spring), the conventional air conditioning system does not operate and no dehumidification is performed.

A third body of art as exemplified by U.S. Pat. Nos. 1,837,798 to Shiplee; 2,154,136 to Parcaro; 2,734,348 to Wright; 2,932,178 to Armstrong; 3,026,687 to Robson and 3,123,492 to McGrath. These patents all use non-heat-pipe technology for transferring heat in an air conditioning system from one location to another but require supplemental utilization to effect the secondary flow of fluids. These patents are deficient since in these patents, difficulties can arise in balancing the refrigerant charge of the primary system. They all contain numerous moving parts such as two-, three- and four-way valves, pumps and controls all of which create a complicated system with a high probability of malfunction.

None of the prior art inventions disclose the utilization of heat-pipe technology for minimum supplemental energy requirements to transfer the heat to the post evaporator position from the post compressor and/or post condenser locations for maximizing the efficiency of the system. The present invention effects its objects and advantages with minimum cost and utilizes only readily available materials in system configuration for retrofitting air conditioning systems without cut-ins or can be used for the generation of a most efficient air conditioning system through the application of the methods and apparatus of the present invention.

Therefore, it is an object of this invention to provide an apparatus which overcomes the aforementioned inadequacies of the prior art devices and provides an improvement which is a significant contribution to the advancement of the air conditioning art.

Accordingly, it is the object of this invention to provide an improved air conditioning method and apparatus comprising a compressor, condenser and evaporator with lines in a primary loop for moving a working fluid in a continuous and automatic cycle of operation between such components; a first reheater located subsequent to the evaporator for heating the post evaporator air with a first supplemental loop coupling the first reheater to the post condenser line; a second reheater located subsequent to the first reheater with a second supplemental loop coupled with the post compressor lines; a valve in the first supplemental loop controlled by a humidistat; and a valve in the second supplemental loop controlled by a thermostat.

It is a further object of the present invention to improve indoor air quality by abating microbiological contaminants enhancing human comfort.

It is a further object of this invention to utilize post evaporator reheat energy to cool an air conditioning refrigerant at a post condenser location.

It is a further object of the present invention to utilize post evaporator reheat energy to cool a conventional air conditioning refrigerant at a post compressor location.

It is a further object of the present invention to use plural post evaporator reheat energies to cool the refrigerant of a conventional air conditioning system at both the post compressor and post condenser locations.

It is a further object of the present invention to cool refrigerant of a conventional air conditioning system without the disruption or cutting-in to the existing air conditioning system.

It is a further object of the present invention to use headered/finned pipes as the reheater of an air conditioning system for maximizing heat transfer and energy utilization for cooling at post compressor and post condenser locations.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiments in addition to the scope of the invention defined by the claims taken in conjunction with the accompanying drawings.

SUMMARY OF THE INVENTION

For the purposes of summarizing this invention, this invention comprises an air conditioning system comprising a compressor, condenser and evaporator with lines in a primary loop for moving a working fluid in a continuous and automatic cycle of operation between such components; a first reheater located subsequent to the evaporator for heating the post evaporator air with a first supplemental loop coupling the first reheater to the post condenser line; a second reheater located subsequent to the first reheater with a second supplemental loop coupled with the post compressor lines; a valve in the first supplemental loop controlled by a humidistat; and a valve in the second supplemental loop controlled by a thermostat.

The invention may also be incorporated into an air conditioning system comprising a compressor, condenser and evaporator with lines in a primary loop for moving a working fluid in a continuous and automatic cycle of operation between such components; and a reheater located subsequent to the evaporator for heating the post evaporator air with a supplemental loop coupling the reheater to the post condenser line for the movement of a working fluid therebetween.

The invention may also be incorporated into an air conditioning system comprising a compressor, condenser and evaporator with lines in a primary loop for moving a working fluid in a continuous and automatic cycle of operation between such components; and a reheater located subsequent to the evaporator for heating the post evaporator air with a supplemental loop coupling the reheater to the post compressor line for the movement of a working fluid therebetween.

The invention may also be incorporated into an apparatus for use with an air conditioning system comprising a compressor, condenser and evaporator with a primary loop for moving a working fluid in a continuous and automatic cycle of operation between such components, the improvement comprising a secondary loop having a reheater positionable subsequent to the evaporator for heating the post evaporator air, the secondary loop located in heat exchanging relationship with a supplemental portion of the primary loop for moving a working fluid in a continuous loop through the secondary loop. The working fluid may Freon. The working fluid of the secondary loop may be water. The secondary loop includes a jacket surrounding a line at the supplemental portion of the primary loop. The supplemental portion may be subsequent to the condenser or the compressor.

The invention may also be incorporated into an air conditioner reheater comprising an upper header for receiving a working fluid from a portion of the air conditioner remote from the evaporator; a lower header for feeding a working fluid to the portion of the air conditioner remote from the evaporator; and a plurality of parallel, generally vertical condenser tubes coupling the upper and lower headers.

The invention may also be incorporated into apparatus for use with an air conditioning system comprising a compressor, condenser and evaporator with a primary loop for moving a working fluid in a continuous and automatic cycle of operation between such components, the improvement comprising a secondary loop having a reheater positionable subsequent to the evaporator for heating the post evaporator air, the secondary loop located in heat exchanging relationship with a supplemental portion of the primary loop for moving a working fluid in a continuous loop through the secondary loop, the reheater comprising an upper header for receiving a working fluid from a portion of the air conditioner remote from the evaporator, a lower header for feeding a working fluid to the portion of the air conditioner remote from the evaporator, and a plurality of parallel, generally vertical condenser tubes coupling the upper and lower headers.

The invention may also be incorporated into an air conditioning method comprising providing components including a compressor, condenser and evaporator with lines in a primary loop; moving a working fluid through the primary loop in a continuous and automatic cycle of operation between such components; providing a secondary loop having a post evaporator reheater and a remote heat exchanger; reheating the post evaporator air to cool working fluid in the secondary loop. The remote heat exchanger may be located at the post condenser line of the primary loop or at the post compressor line of the primary loop or there are two remote heat exchangers, one located at the post condenser line and one located at the post compressor line.

The invention may also be incorporated into an air conditioning method comprising the steps of providing components including a compressor, condenser and evaporator with lines in a primary loop for moving a working fluid in a continuous cycle of operation between such components; providing a first reheater located subsequent to the evaporator for heating the post evaporator air with a first supplemental loop coupling the first reheater to the post condenser line; providing a second reheater located subsequent to the first reheater with a second supplemental loop coupled with the post compressor lines; and moving a working fluid through the primary and two supplemental loops in a continuous cycle of operation. The first supplemental loop includes a jacket surrounding the associated line of the primary loop. The second supplemental includes a jacket surrounding the associated line of the primary loop.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other constructions and methods for carrying out the same purposes of the present invention. It should also be realized by those skilled in the art that such equivalent constructions and methods do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
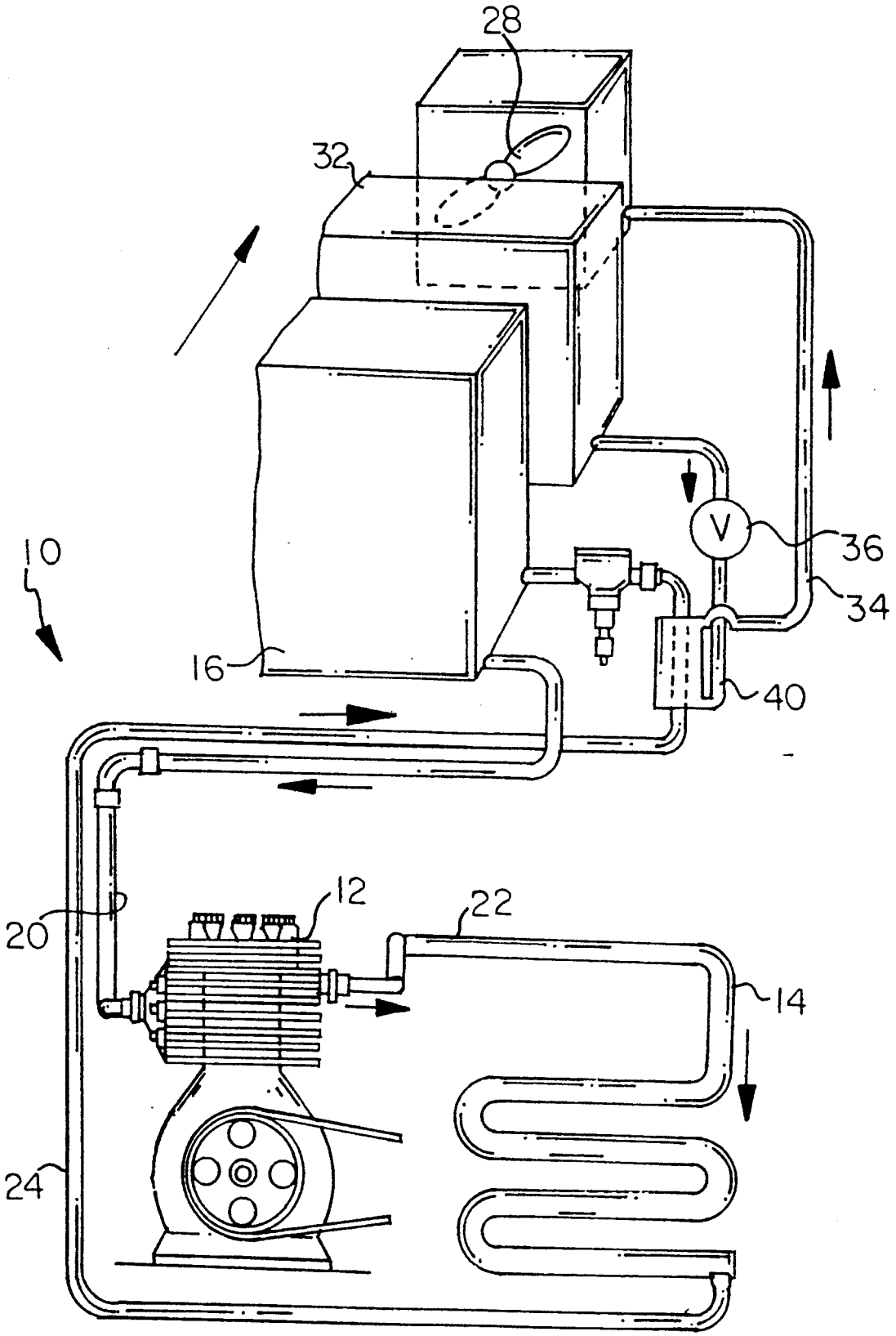
FIG. 1 is a partially schematic illustration of a post condenser cooling system coupled with a post evaporator reheater.

Shown in the various Figures are three embodiments of the present air conditioning system 10. In the FIG. 1 embodiment, there is shown a conventional air conditioning system 10 in association with the improvements of the present invention. The basic air conditioning system of FIG. 1 is the same for the embodiments of FIGS. 2 and 3. In accordance with these embodiments, the basic air conditioning system has three major components.

These three system components include the compressor 12, condenser 14 and evaporator 16. The air conditioning system moves a working fluid, preferably Freon, by conventional pipes 20, 22 and 24 through these operational components in a continuous and automatic cycle of operation. The working fluid may also be other fluids such as alcohol or the like capable of accepting and giving up heat energy as its temperature increases and decreases and as its state changes between gas and liquid.

At the compressor 14, the working fluid enters through a line 20 as a low temperature gas at about 65 degrees Fahrenheit and is compressed to leave through a line as a high temperature gas at about 150 degrees Fahrenheit. The compressor is normally outside the building to be cooled.

The working fluid then moves in its gaseous state through a line 22 to the condenser 14, normally outside the building to be cooled. At the condenser, the received gas, at about 150 degrees Fahrenheit, decreases in temperature and becomes a liquid at about 90 degrees Fahrenheit. Thereafter, a line 24 directs the liquid working fluid to the evaporator 16.

The evaporator is inside the building to be cooled. At the evaporator, the received liquid, at about 90 degrees Fahrenheit, is cooled as it expands to a gas of about 45 degrees Fahrenheit. At the evaporator, the air to be cooled is, for example, initially at about 80 degrees Fahrenheit. Such air is moved by a fan 28 through the evaporator and becomes cooled to about 50 to 55 degrees Fahrenheit or lower. The lines 20, 22 and 24, in combination with the compressor 12, condenser 14 and evaporator 16 define a primary loop.

In accordance with the FIG. 1 embodiment, a reheater 32 is provided to intercept the cooled air following the evaporator 16. The reheater functions to heat the cooled air from about 50 to 55 degrees Fahrenheit to a more comfortable elevated temperature of about 60 to 70 degrees Fahrenheit. The reheater includes a closed line 34 and a valve 36 and functions to convert the nonuseful heat energy into useful energy. More specifically, the supplemental closed line 34 contains a working fluid, the same or similar to that in the primary conventional air conditioning loop. The working fluid of the secondary loop may also be water. The fluid functions to heat the air as it condenses from a gas to a liquid in its reheater. The liquified working fluid in the reheater then moves from the top of the reheater through a line by gravity to a jacket 40 sealingly secured around the post evaporator line of the primary air conditioning loop. Line 34 with reheater 32 and jacket 40 define a secondary loop. At the jacket, heat from the post evaporator line is transferred to the working fluid of the primary line to vaporize the fluid to a gas. The gas then moves to the top of the reheater to heat the post evaporator air and then moves in a continuing cycle to cool the post condenser gases. The fluid of this secondary loop changes at the reheater from a gas to a liquid at about 72 degrees Fahrenheit and from a liquid to a gas at about 72 degrees Fahrenheit at the post condenser zone.

No pumps are needed to effect the desired movement of working fluid in the secondary or reheater loop. Movement is effected through heat-pipe technology. By this it is meant that in the jacket, as the working fluid absorbs heat and changes from a liquid to a vapor, it is thermodynamically driven to the reheater because of the temperature and pressure differentials which exist between the jacket and the reheater. The vapor in the jacket creates a high pressure and the condensation of the gas to a liquid in the reheater creates a low pressure. The vapor will travel from the high pressure to the low pressure. After condensing in the reheater, the liquified working fluid flows by gravity to the jacket.

Figure 2:
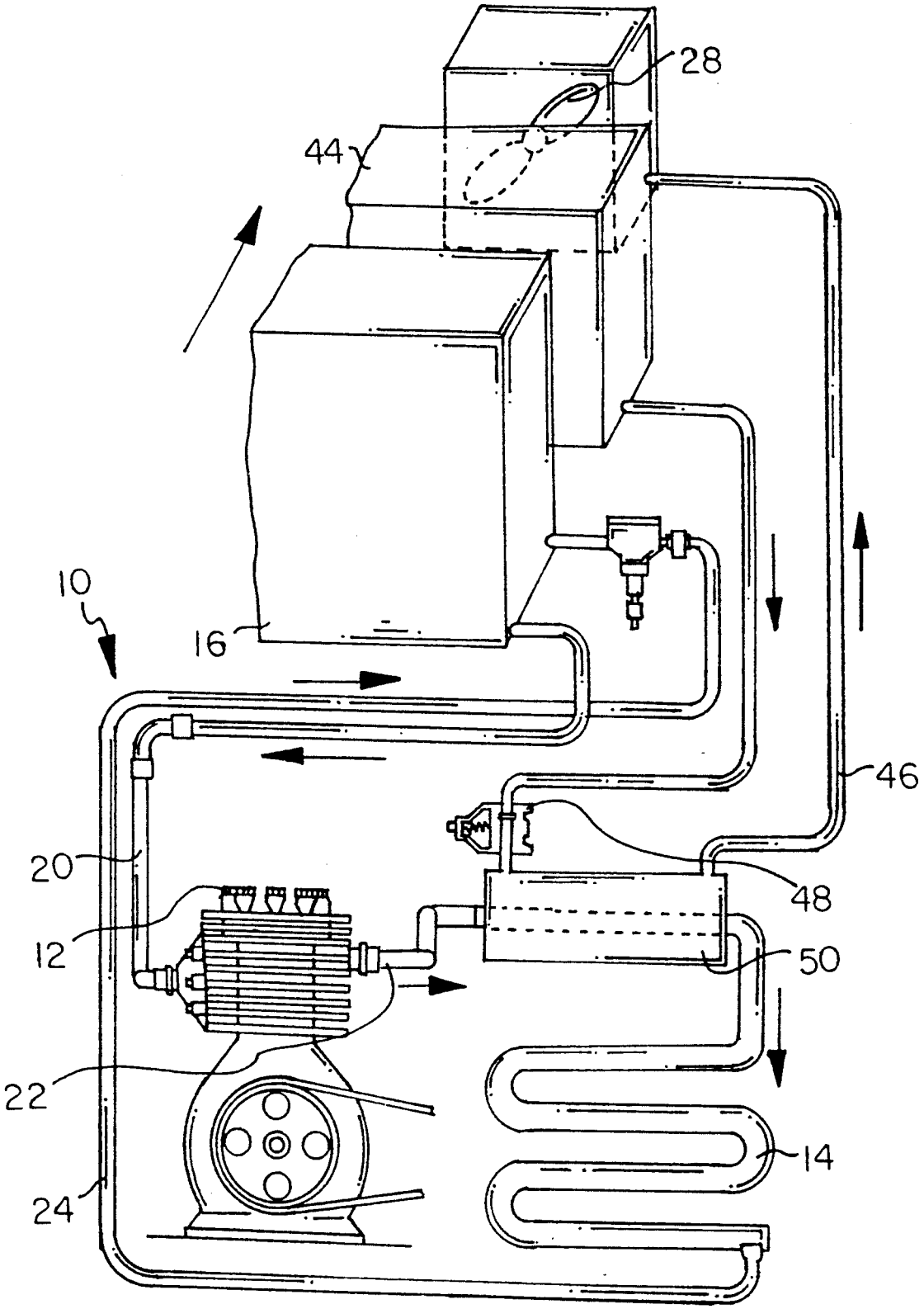
FIG. 2 is a partially schematic illustration of a post compressor cooling system coupled with a post evaporator reheater.

In accordance with the FIG. 2 embodiment, a reheater 44 is provided to intercept the air following the evaporator 16. The reheater functions to heat the cooled air from about 50 to 55 degrees Fahrenheit to a more comfortable elevated temperature of about 60 degrees Fahrenheit or higher. The reheater includes a closed line 46, and a valve 48 and functions to convert the waste heat energy into useful energy. The primary loop is essentially the same a that of the first embodiment of FIG. 1. More specifically, the supplemental closed line 46 contains a working fluid, the same or similar to that in the primary conventional air conditioning loop. The fluid functions to heat the air as it condenses from a gas to a liquid in its reheater. The liquified working fluid in the reheater then moves through a line by gravity to a jacket 50 around the post compressor line of the primary air conditioning loop. At the jacket, heat from the post condenser line is transferred to the working fluid to vaporize the fluid to a gas. The gas then moves to the reheater 44 to heat the post evaporator air and then moves to the bottom of the reheater in a continuing cycle to cool the post condenser gases. The fluid of this second cycle changes at the reheater 44 from a gas to a liquid at about 102 degrees Fahrenheit and from a liquid to a gas at about 102 degrees Fahrenheit at the post compressor zone.

Figure 3:
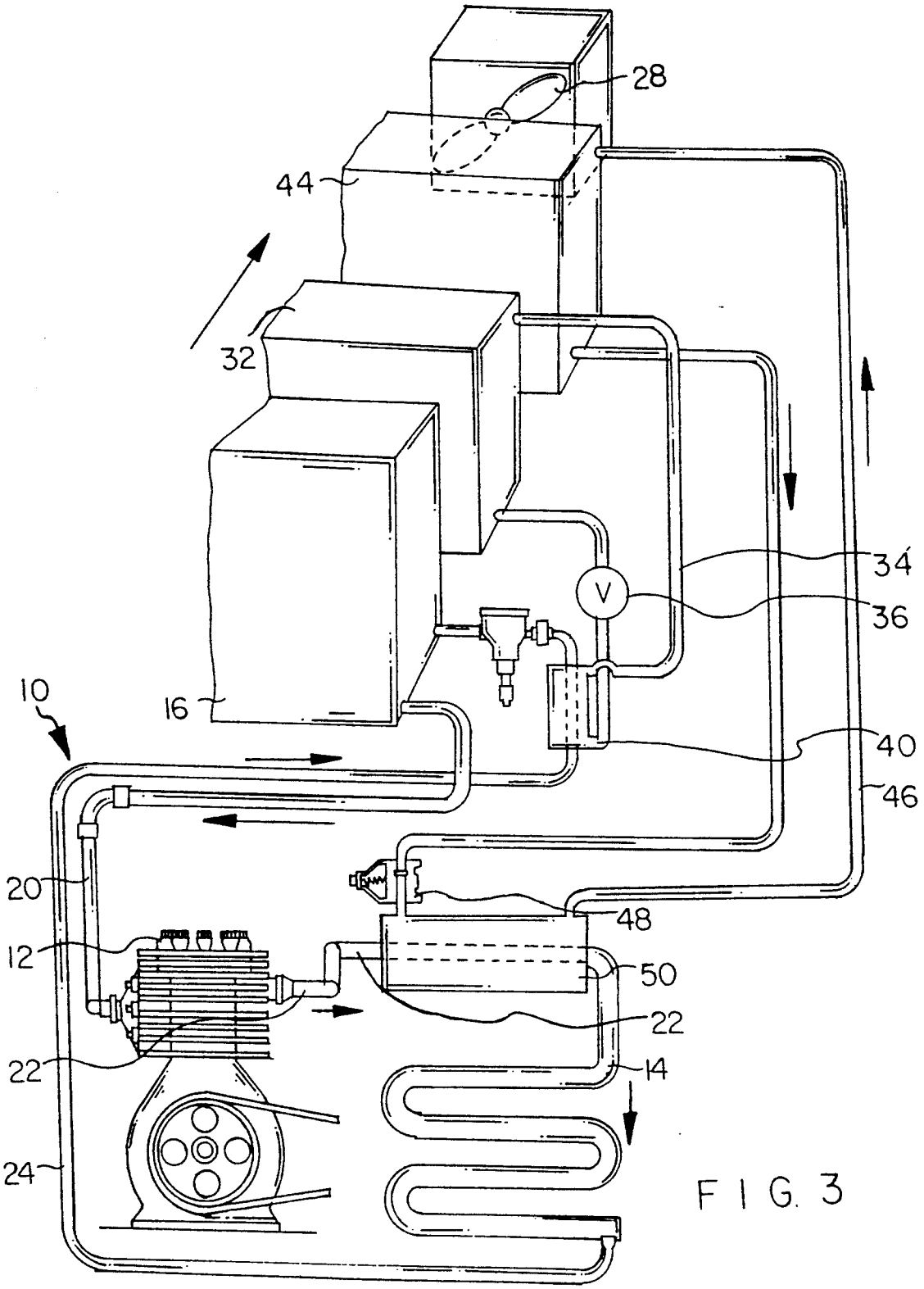
FIG. 3 is a partially schematic illustration of an air conditioning system employing two reheaters, the first coupled for cooling at the post condenser location and the second coupled for cooling at the post compressor location.

In the FIG. 3 embodiment, the reheating of the post evaporator air is used to cool the post condenser working fluid of the primary loop as in FIG. 1 and the post compressor working fluid of the primary loop as in FIG. 2. The primary loop is essentially the same as in the first and second embodiments of FIGS. 1 and 2. As a result, the heating of the post evaporator air goes from about 50 to 55 degrees Fahrenheit immediately prior to the primary reheater 32 to about 60 degrees Fahrenheit prior to the secondary reheater 44 and emerges for use at about 70 degrees Fahrenheit or higher. Lines 34 and 46 extend from the primary and secondary reheaters to the lines 24 and 22 at the post condenser zone and the post compressor zone. Temperatures and working fluid states at these various stages are similar to the FIG. 1 and FIG. 2 embodiments. Each secondary loop functions independently of the other secondary loop.

The two secondary loops functioning together will provide improved dehumidification throughout the entire year. When the post condenser refrigerant in the conventional air conditioning system is cooled, the evaporator will remove more moisture from the air passing through it. Then the air is reheated by the reheater. Because the conventional air conditioning system does not operate under conditions of low heat load (i.e. spring and fall), the second reheater coupled to the post compressor line will provide a free heat load to cause the entire system to operate and provide dehumidification.

The valves 36 and 48 of the secondary loops can each function independently of the other for opening and closing its associated line as a function of temperature, humidity, time, pressure or the like, all in a conventional manner. When, however, used together in the FIG. 3 embodiment, they function in synergism. Valve 36 is preferably controlled by a humidistat, and valve 48 is preferably controlled by a thermostat. Working together in this manner, they provide temperature and humidity control through the year regardless of the heat load.

Recent studies of indoor air quality have indicated that microbiological contamination (i.e. mold and bacteria) is a serious health threat to human beings. In fact, the World Health Organization has identified microbial contamination as number five of the top five health threats to human beings in buildings. The only practical way to control microbial contamination in a building is to control the humidity. Without moisture, these organisms cannot survive.

Figure 4:
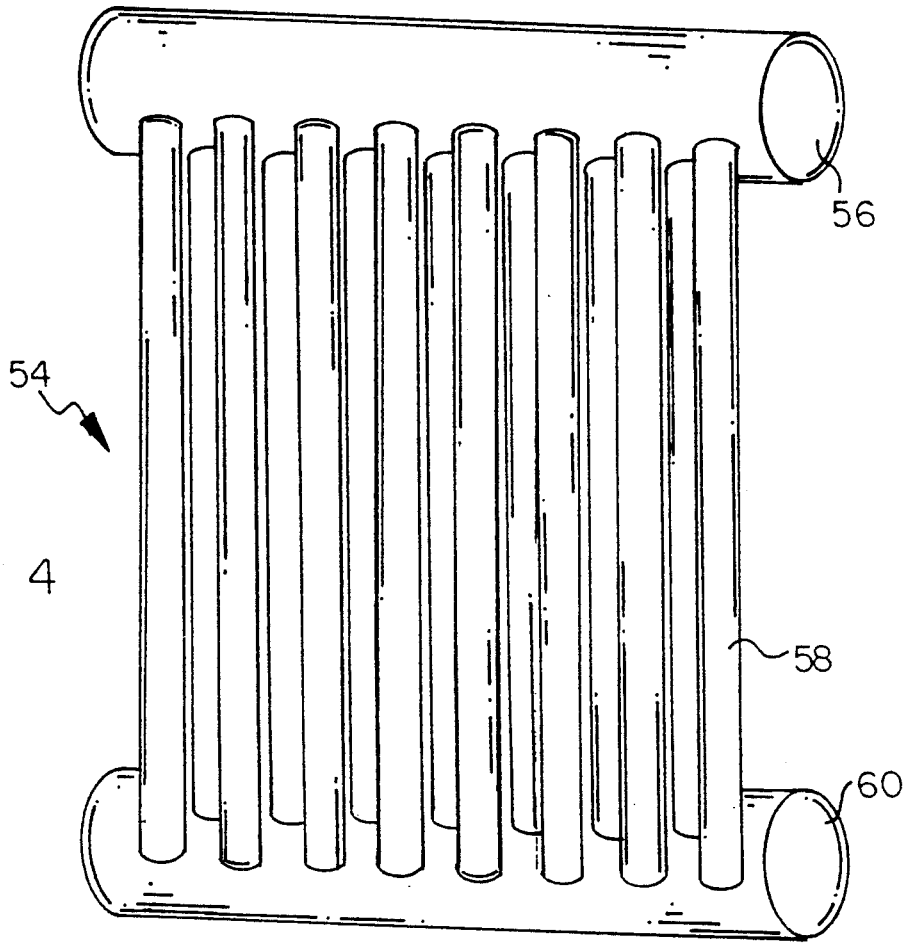
FIGS. 4, 5 and 6 are schematic illustrations of an improved reheater.
Figure 5:
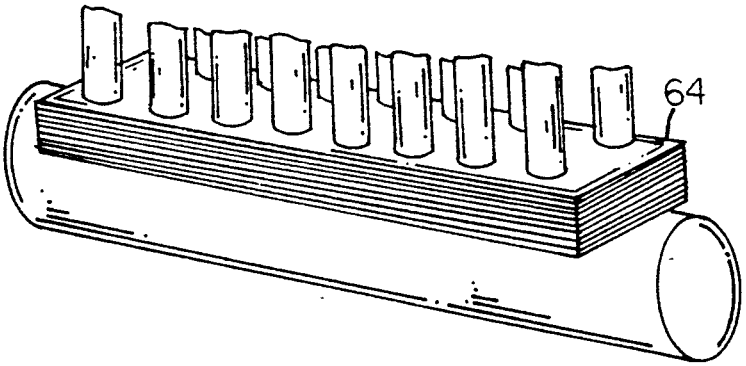
Figure 6:
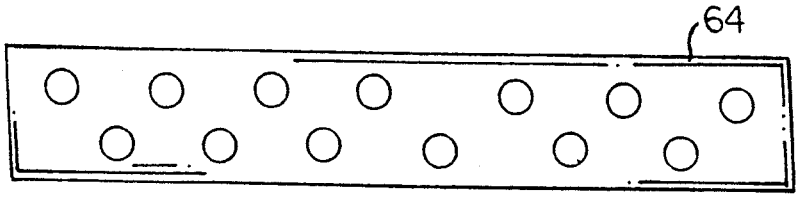

Lastly, in the illustrations of FIGS. 4, 5 and 6, an improved reheater 54 is provided. Features of the reheater shown in these Figures include a primary or upper header 56 for receiving the vapor from a line of one of the secondary reheater loops. The upper header 54 for each loop receives all of the gases from the post condenser and post compressor zones respectively. The received heated working fluid in a gaseous state then passes downwardly through a plurality of parallel heat exchange pipes 58 to the lower or secondary header 60. The heat exchange pipes are provided with spaced fins 64 along their entire lengths. The fins are preferably in the form of aperture plates with offset holes for receiving the offset pipes. Thereafter, the received gases of the working fluid are cooled to the liquid state and moved to the post condenser and post compressor zones, respectively. Such an arrangement effects a most efficient heating of the post evaporator air and cooling of the working fluid.

In carrying out the method of the present invention, an air conditioning method comprises the steps of providing a compressor, condenser and evaporator with a primary loop for moving a working fluid in a continuous and automatic cycle of operation between such components. The method further includes the step of providing a first reheater located subsequent to the evaporator for heating the post evaporator air with a first supplemental loop coupling the first reheater to the post condenser line. The method further includes the step of providing a second reheater located subsequent to the first reheater with a second supplemental loop coupled with the post compressor line. The method further includes the step of moving a working fluid through the primary and two supplemental loops in a continuous cycle of operation. The first supplemental loop includes a jacket surrounding the associated line of the primary loop. The second supplemental includes a jacket surrounding the associated line of the primary loop. It should be understood that the method may include the use of the two reheaters with their associated jackets or, in the alternative, either one of the two reheaters and its associated jacket as a function of the particular application.

While the present invention has been described with regard to particular embodiments it is intended to be covered broadly within the spirit and scope of the appended claims.

What is claimed is:

1. An air conditioning system comprising:

a compressor, condenser and evaporator with lines in a primary loop for moving a working fluid in a continuous and automatic cycle of operation between such components;

a first heater located subsequent to the evaporator for heating the post evaporator air with a first supplemental loop coupling the first reheater to the post condenser line;

a second reheater located subsequent to the first reheater with a second supplemental loop coupled with the post compressor lines;

a valve in the first supplemental loop controlled by a humidistat; and a valve in the second supplemental loop controlled by a thermostat.

2. An air conditioning method comprising the steps of:

providing components including a compressor, condenser and evaporator with lines in a primary loop for moving a working fluid in a continuous cycle of operation between such components;

providing a first reheater located subsequent to the evaporator for heating the post evaporator air with a first supplemental loop coupling the first reheater to the post condenser line;

providing a second reheater located subsequent to the first reheater with a second supplemental loop coupled with the post compressor lines; and moving a working fluid through the primary and two supplemental loops in a continuous cycle of operation.

3. The method as set forth in claim 2 wherein the first supplemental loop includes a jacket surrounding the associated line of the primary loop.

4. The method as set forth in claim 2 wherein the second supplemental includes a jacket surrounding the associated line of the primary loop.

5. An air conditioning system comprising:

a compressor, condenser and evaporator with lines in a primary loop for moving a working fluid in a continuous and automatic cycle of operation between such components;

a first reheater located subsequent to the evaporator for heating the post evaporator air with a first supplemental loop coupling the first reheater to the post condenser line;

a second reheater located subsequent to the first reheater with a second supplemental loop coupled with the post compressor lines; and a valve in the second supplemental loop controlled by a thermostat.

6. An air conditioning apparatus comprising:

components including a compressor, condenser and evaporator with lines in a primary loop for moving a working fluid in a cycle of operation between such components;

a first reheater located subsequent to the evaporator for heating the post evaporator air with a first supplemental loop coupling the first reheater to the post condenser line;

a second reheater located subsequent to the first reheater with a second supplemental loop coupled with the post compressor lines; and means to move a working fluid through the primary and two supplemental loops in a cycle of operation.

7. The apparatus as set forth in claim 6 wherein the first supplemental loop includes a jacket surrounding the associated line of the primary loop.

8. The apparatus as set forth in claim 6 wherein the second supplemental includes a jacket surrounding the associated line of the primary loop.

* * * * *